United States Patent [19]

Shiokawa et al.

[11] 3,949,974

[45] Apr. 13, 1976

[54] APPARATUS FOR PREVENTING RAW MIX FROM BEING UNEVENLY SINTERED BY A SINTERING MACHINE

[75] Inventors: Nobumasa Shiokawa; Masakazu Maeda, both of Chiba; Takashi Harada, Yachiyo; Tsuguo Takehara, Chiba; Hiroyuki Fujikawa, Chiba; Akio Yokokawa, Chiba, all of Japan

[73] Assignee: Kawasaki Steel Corporation, Kobe, Japan

[22] Filed: Mar. 20, 1975

[21] Appl. No.: 560,135

Related U.S. Application Data

[63] Continuation-in-part of Ser. No. 318,984, Dec. 27, 1972, abandoned.

[30] Foreign Application Priority Data

Nov. 8, 1972 Japan ..... 47-111877

[52] U.S. Cl. ..... 266/21; 266/20; 432/37; 432/45

[51] Int. Cl.[2] ..... F27B 21/00

[58] Field of Search ..... 75/5; 236/15 B; 266/20, 266/21; 432/37, 45, 137

[56] References Cited

UNITED STATES PATENTS

| | | | |
|---|---|---|---|
| 2,878,003 | 3/1959 | Dukeman et al. | 432/45 X |
| 3,211,441 | 10/1965 | Miyakawa et al. | 266/21 |
| 3,262,770 | 7/1966 | Tsujihata et al. | 75/5 |
| 3,275,431 | 9/1966 | Sawada | 75/5 |
| 3,491,990 | 1/1970 | Pozefsky | 266/21 X |
| 3,578,437 | 5/1971 | Higuchi et al. | 75/5 |
| 3,746,537 | 7/1973 | Haibach | 266/21 X |
| 3,802,677 | 4/1974 | Sironi | 266/21 X |
| 3,816,096 | 6/1974 | Tsujihata | 75/5 |

*Primary Examiner*—Roy Lake
*Assistant Examiner*—Paul A. Bell
*Attorney, Agent, or Firm*—Fleit & Jacobson

[57] ABSTRACT

A method of preventing a raw mix disposed on a pallet of a moving grate type sintering machine from being unevenly sintered in the transverse direction extending across the width of the sinter and an apparatus for carrying out the method are disclosed. The raw mix is fed on moving pallets which form the bed. The temperature distribution of waste gas soon after it has passed through the bed in a direction perpendicular to the bed is measured at the sinter exit side of the sintering machine. The temperature thus measured is utilized to adjust the amount of raw mix to be delivered from a surge hopper upon the pallet and adjust the density of the packed layer and hence correct the gas-permeability of the bed and the sintering effect upon the bed in its transverse direction. Thus, the sintering bed is prevented from being unevenly sintered by the sintering machine.

4 Claims, 8 Drawing Figures

C
a
a
10
1
9'
A
3
8
7
6
4
16
5
2
A
9

Temperature of waste gas in wind box (°C)
500
400
300
10c
10d
10b
10e
10a
0
1
2
3
4
5
6
7
8
Sintering time (hrs.)
Time from which is started adjustment of auxiliary gates

APPARATUS FOR PREVENTING RAW MIX FROM BEING UNEVENLY SINTERED BY A SINTERING MACHINE

This application is a continuation-in-part of our copending application; Ser. No. 318,984, and now abandonded filed Dec. 27, 1972, for "Method of Preventing Raw Mix From Being Unevenly Sintered by a Sintering Machine and an Apparatus for Carrying out the Method".

This invention relates to methods of preventing raw mix from being unevenly sintered by a sintering machine, and more particularly to a method of preventing raw mix disposed on a pallet of a moving grate-type sintering machine from being unevenly sintered in the transverse direction extending across the width of the sinter, and an apparatus for carrying out the method.

In case of sintering a raw mix by a moving grate-type sintering machine, in the first place, the raw mix contained in a surge hopper is delivered onto a moving pallet and then the sinter disposed on the pallet is subjected to pressure and confined into bed which is subsequently ignited and sintered.

But, at the sinter exit side of the sintering machine, there is produced in the sintering bed in the transverse direction one region which is sufficiently burnt, and another region which is not sufficiently burnt, and as a result, uneven sintering of the sintering bed occurs in the direction extending across its width.

In the same manner as uneven sintering phenomenon of the sintering bed in its lengthwise or longitudinal direction, the above mentioned uneven sintering results in the degradation and and inhomogeneity of quality of the sinter, and disadvantages such, for example, as changes in shatter strength, grain size, chemical composition, etc. which are so great as to increase the rate of producing return fines, and as a result, the yield is reduced excessively, thereby resulting in a remarkable hindrance to the production of the sinter.

Various methods of preventing the bed from being unevenly sintered in the moving grate-type sintering machine in its lengthwise or longitudinal direction have heretofore been proposed with considerable success obtained.

A method of reliably and effectively preventing the bed from being unevenly sintered in the moving grate sintering machine in its transverse direction, however, has never been realized.

In the conventional method, the uneven sintered state of the bed in its transverse direction is viewed with the naked eye and that region of the bed which is not sufficiently burnt, if present, is made completely burnt by the following two methods, i.e.

1. The strand speed of the sintering machine is retarded.

2. An opening formed between a gate and feeding drum through which is delivered raw mix onto the pallet of the sintering machine is adjusted over a long interval of time.

In the former method, the strand speed of the sintering machine must be intensely retarded if it is desired to accelerate the sintering effect upon that region of the bed at which the ore is not sufficiently burnt. Thus, another region of the bed where the ore has sufficiently been burnt becomes oversintered, and as a result, the efficiency of producing the sinter as a whole is considerably lowered.

In the latter method, the adjustment of the opening formed between the gate and the feeding drum over a long interval of time results in a considerable time lag in case of adjusting the sintering operation which causes the sintering effect upon the ore in its transverse direction to be roughly adjusted and hence it is impossible to prevent the bed from being unevenly sintered in its transverse direction by the moving grate-type sintering machine.

Many attempts have been made to overcome this problem, but hitherto none has led to fully satisfactory results.

By investigating the state of sinter in detail the inventors have found out that the above mentioned unevenness of the sintered state of the bed in the direction extending across its width is mainly due to uneveness of gas-permeability of the bed in its transverse direction at the ore inlet side of the sintering machine.

The unevenness of gas-permeability of the bed in its transverse direction is caused for example by the grate getting clogged with the raw mix, the unbalanced state of the opening formed between the gate and the feeding drum, the gate getting clogged with the raw mix, the raw mix packed in the pallet in difference thicknesses in its transverse direction, the lower edge of a cut-off plate inclined from the surface of the bed, etc. Heretofore, it has been almost impossible to remove all of these causes.

The object of the invention, therefore, is to obviate the above mentioned disadvantages.

The object of the invention is realized by measuring the temperature distribution of waste gas immediately after it has passed through the sintering bed in a direction perpendicular to the bed and has arrived at the sinter exit side of the sintering machine, and by adjusting the amount of raw mix to be delivered from the surge hopper upon the pallet in its transverse direction extending across the width of the bed in response to the temperature distribution of the waste gas thus measured whereby the density of the bed in its transverse direction is adjusted.

A preferred embodiment of the invention is illustrated in the following drawings in which.

Figure 6:
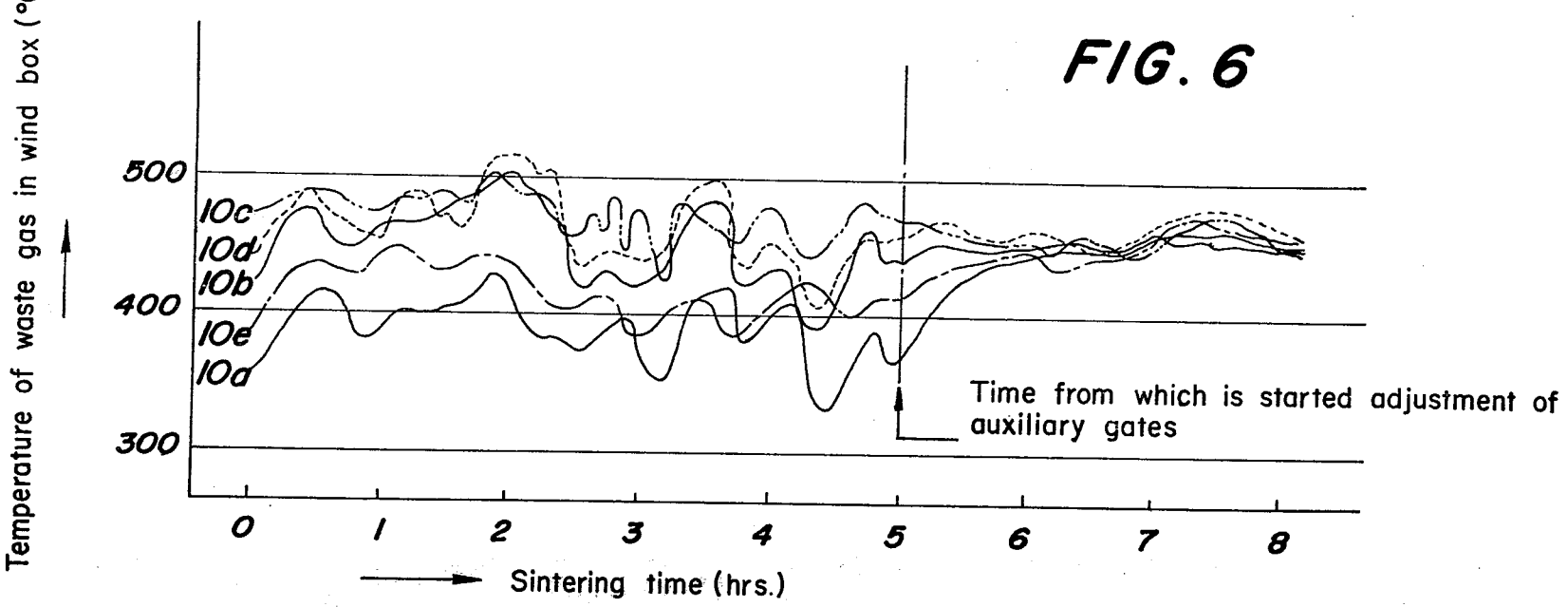
Figure 7:
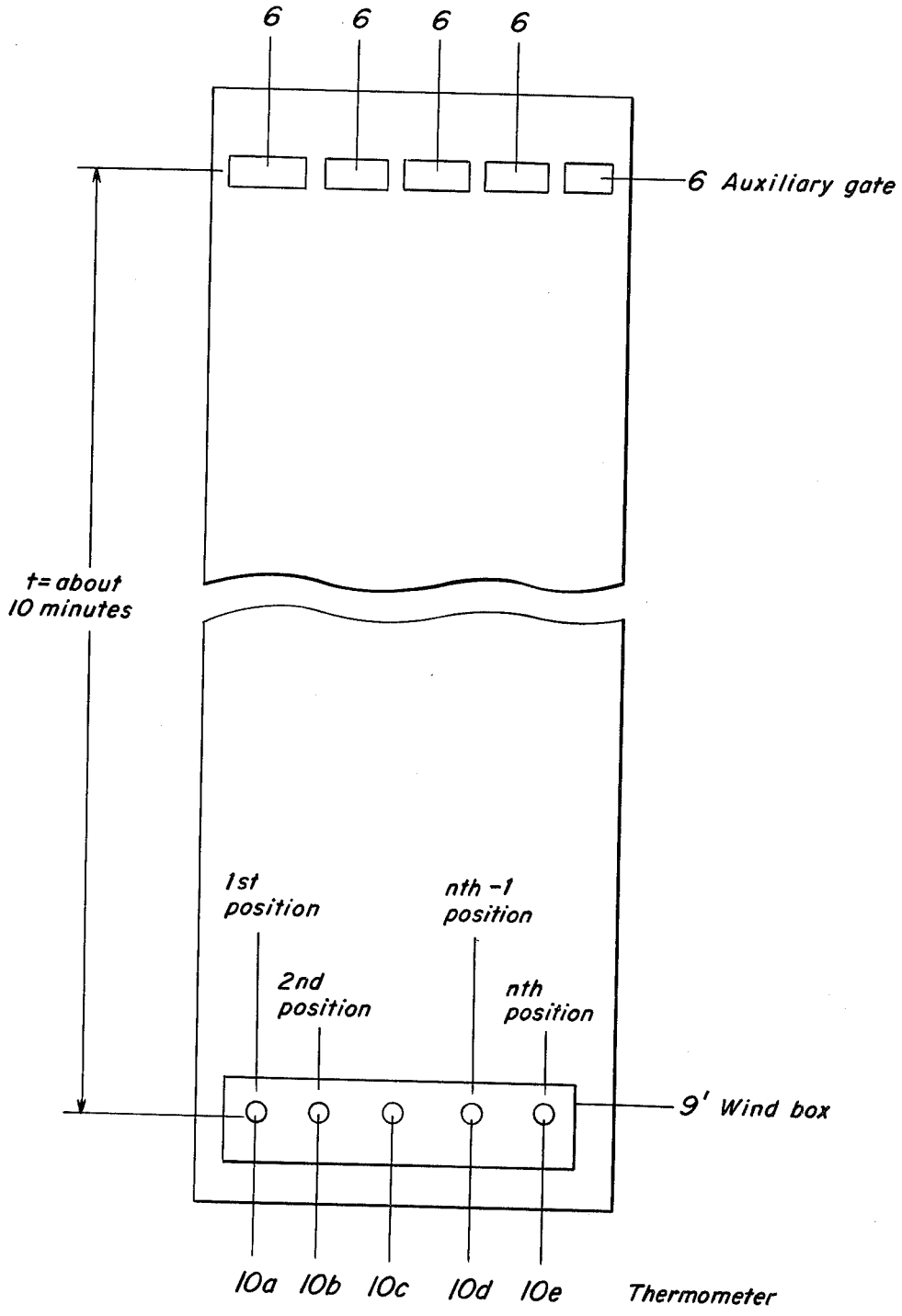

FIG. 6 is a graphical representation of the relation between the sintering time and the temperatures of waste gas immediately after it has passed through the bed in a direction perpendicular to the bed; and FIG. 7 is schematic illustration of the arrangement of the gates 6 and the thermometers 10*a*–10*e* in the wind boxes 9′.

Figure 1:
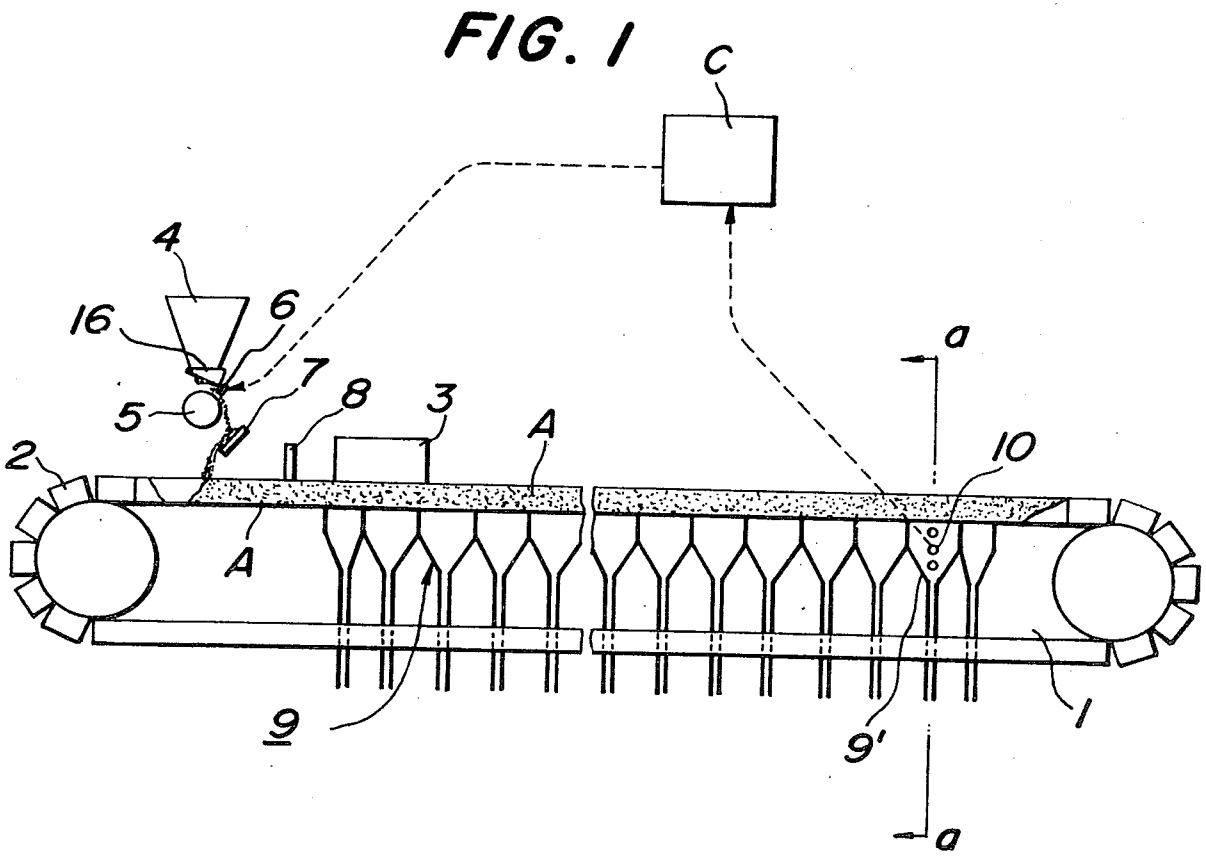
FIG. 1 shows diagrammatically a side elevation of the relative arrangement of the main parts of an embodiment of an apparatus according to the invention, partly in section.

Referring to FIG. 1, reference numeral 1 designates a moving grate-type sintering machine proper, 2 a pallet, 3 an ignition furnace, 4 a surge hopper containing a raw mix, 5 a feeding drum, 16 a main gate adapted to be opened and closed in response to a desired yield, 6 a plurality of equidistantly spaced apart auxiliary gates arranged near the periphery of the drum 5 in its transverse direction and adapted to minutely adjust the amount of raw mix delivered from the main gate 16 in its transverse direction, 7 a sloping plate along which is moved downwards the raw mix upon the pallet 2, 8 a cut-off plate for applying pressure to the raw mix disposed on the pallet 2 so as to confine it into a bed A, 9 a group of wind boxes arranged in succession beneath the pallets 2 in its lengthwise or longitudinal direction, and 10 a plurality of thermometers arranged in a wind box 9' located at the sinter exit side of the machine and arranged in its transverse direction.

The raw mix contained in the surge hopper 4 is delivered through an opening $H_1$ (FIG. 3) provided at its lower front side, main gate 16, auxiliary gates 6, feeding drum 5, and sloping plate 7 to the pallet 2. The sloping plate 7 serves to absorb the dropping energy of the raw mix.

The raw mix is moved together with the pallets 2 in an endless manner and at first is subjected to pressure by the lower edge of the cut-off plate 8 and hence confined into the bed A which has a dense and flat and smooth surface. Then the bed A enters the ignition furnace 3 where it is exposed to combustion heat generated by combustion gas and air blown thereinto whose amount is controlled beforehand. Thus, the bed A is ignited and completely sintered at the ore exit end of the machine.

In the above mentioned sintering process, the gas-permeability distribution in the bed A in the direction extending across its width becomes irregular. This irregular gas-permeability distribution causes a change in temperature distribution in the bed A in its transverse direction at the ore exit side extending from the ignition furnace 3 to the ore exit end. In accordance with the invention, such change in temperature distribution of the bed A in its transverse direction is measured for the purpose of preventing the bed A from being unevenly sintered in the direction extending across its width. In order to effect such temperature measurement use may be made of a plurality of thermometers 10 arranged in that wind box which is located at the ore exit side with respect to the ignition furnace 3 and more particularly in the wind box 9' which is located near a position where the combustion of the bed A is completed. The thermometers 10 may be arranged, for example, in the wind box 9' which is the second one counted from the ore exit end and located near the lower surface of the pallet 2. In the embodiment shown in FIG. 2A, five equidistantly spaced apart thermometers 10*a*, 10*b*, 10*c*, 10*d* and 10*e* are arranged in the wind box 9' in its transverse direction. These thermometers 10*a* to 10*e* serve to measure the temperature of waste gas soon after it has passed through the bed A.

Experimental tests have yielded the surprising result that the state of combustion of the bed A in its transverse direction corresponds to the temperature distribution of the waste gas immediately after it has passed through the bed A. The invention makes use of such relation and provides an economical way of preventing the bed A from being unevenly sintered in its transverse direction.

In general, that region of the bed A which is located at the ore inlet side and subjected to good gas-permeability in its transverse direction becomes easily combustible, and as a result, the temperature of the waste gas soon after it has passed through such region at the ore exit side with respect to the ignition furnace 3 becomes high, while that region of the bed A which is located at the ore inlet side and subjected to poor gas permeability in its transverse direction becomes hardly combustible, and as a result, the temperature of waste gas soon after it has passed through such region at the ore exit side with respect to the ignition furnace 3 becomes low.

Thus, the change in temperature distribution of the bed A in its transverse direction at the ore exit side with respect to the ignition furnace 3 is created by the variation in gas permeability distribution of the bed A in its transverse direction at the ore inlet side so that it can be determined by measuring the temperature of waste gas soon after it has passed through the bed A and the state of unevenness of the sintering effect upon the bed A can be corrected by the temperatures as measured.

Figure 2A:
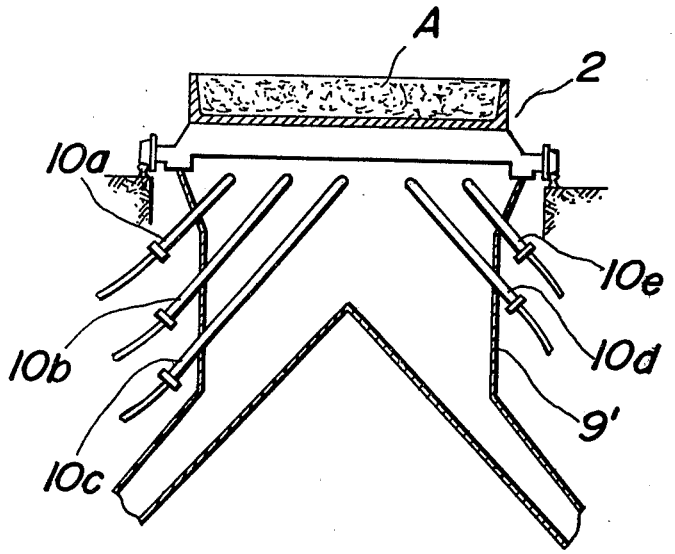
FIG. 2A is an enlarged detailed cross-section taken on line a—a of FIG. 1 and showing thermometers for measuring the temperature of waste gas immediately after it has passed through a sintering bed in a direction perpendicular to the bed.
Figure 2B:
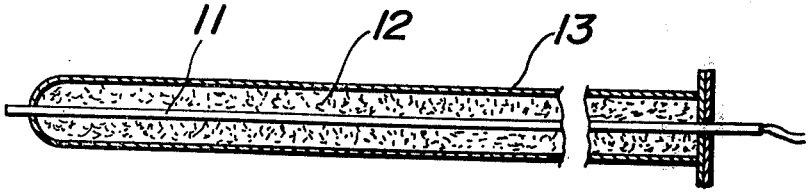
FIG. 2B is an enlarged detailed cross-section of a thermometer shown in FIG. 2A.

In FIG. 2A are shown five equidistantly spaced apart thermometers 10*a*, 10*b*, 10*c*, 10*d* and 10*e* arranged in the wind box 9' in its transverse direction and near the lower surface of the pallet 2. These thermometers serve to measure the temperature of waste gas soon after it has passed through the bed A and each may be made of a conventional thermocouple type thermometer. In FIG. 2B is shown a chromel-alumel thermocouple type thermometer comprising a sheath thermocouple 11 having a diameter of 1.6 mm and a thermo-well 13 filled with MgO powders 12 in which is embedded the sheath thermocouple 11. The chromel-alumel thermocouple type thermometer shown in FIG. 2B is preferable since it can measure the temperature of waste gas in a sensitive manner and is durable for a long use.

In accordance with the invention, the amount of raw mix to be confined to the bed A in its transverse direction is adjusted such that the amount of raw mix is increased at those regions of the bed A which are subjected to good gas permeability and that the amount of raw mix is decreased at those regions of the bed A which are subjected to poor gas permeability. In accordance with the invention, in order to adjust the amount of raw mix to be charged into the pallet 2 along its transverse direction, use is made of a plurality of equidistantly spaced apart auxiliary gates 6 arranged between the main gate 16 and the feeding drum 5 and side by side along the transverse direction of the pallet 2.

Figure 3:
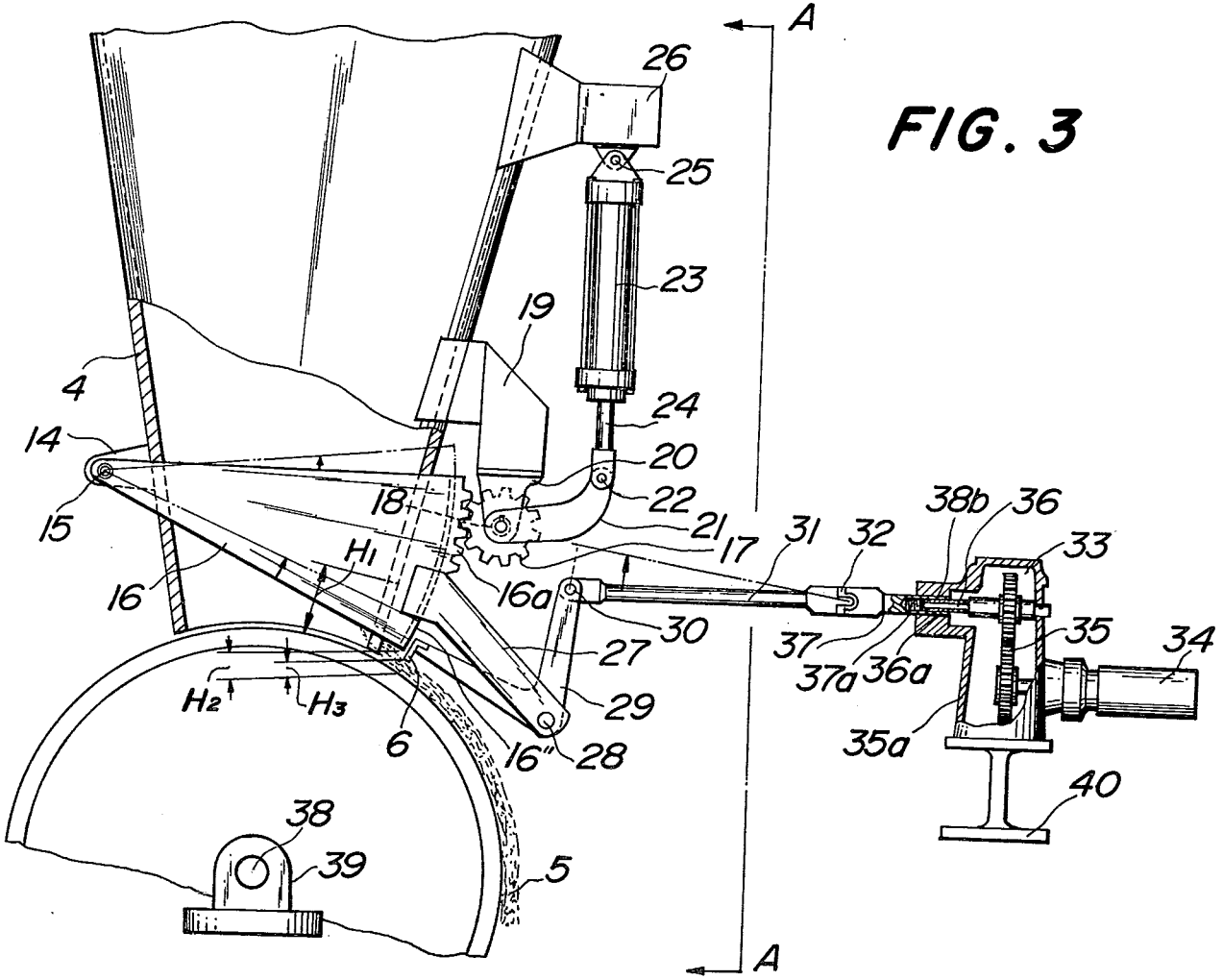
FIG. 3 is an enlarged side elevational view of main and auxiliary gates and operating means thereof.
Figure 4:
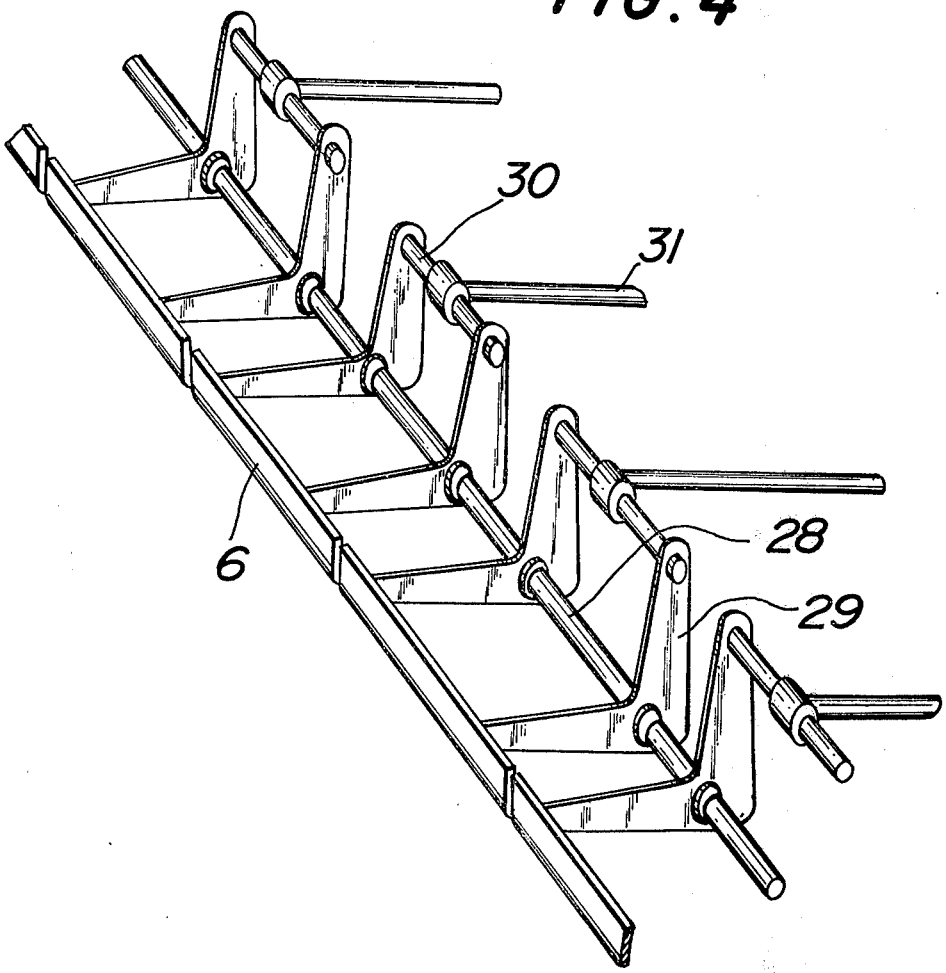
FIG. 4 is a perspective view of a plurality of equidistantly spaced apart auxiliary gates and operating link mechanisms thereof.
Figure 5:
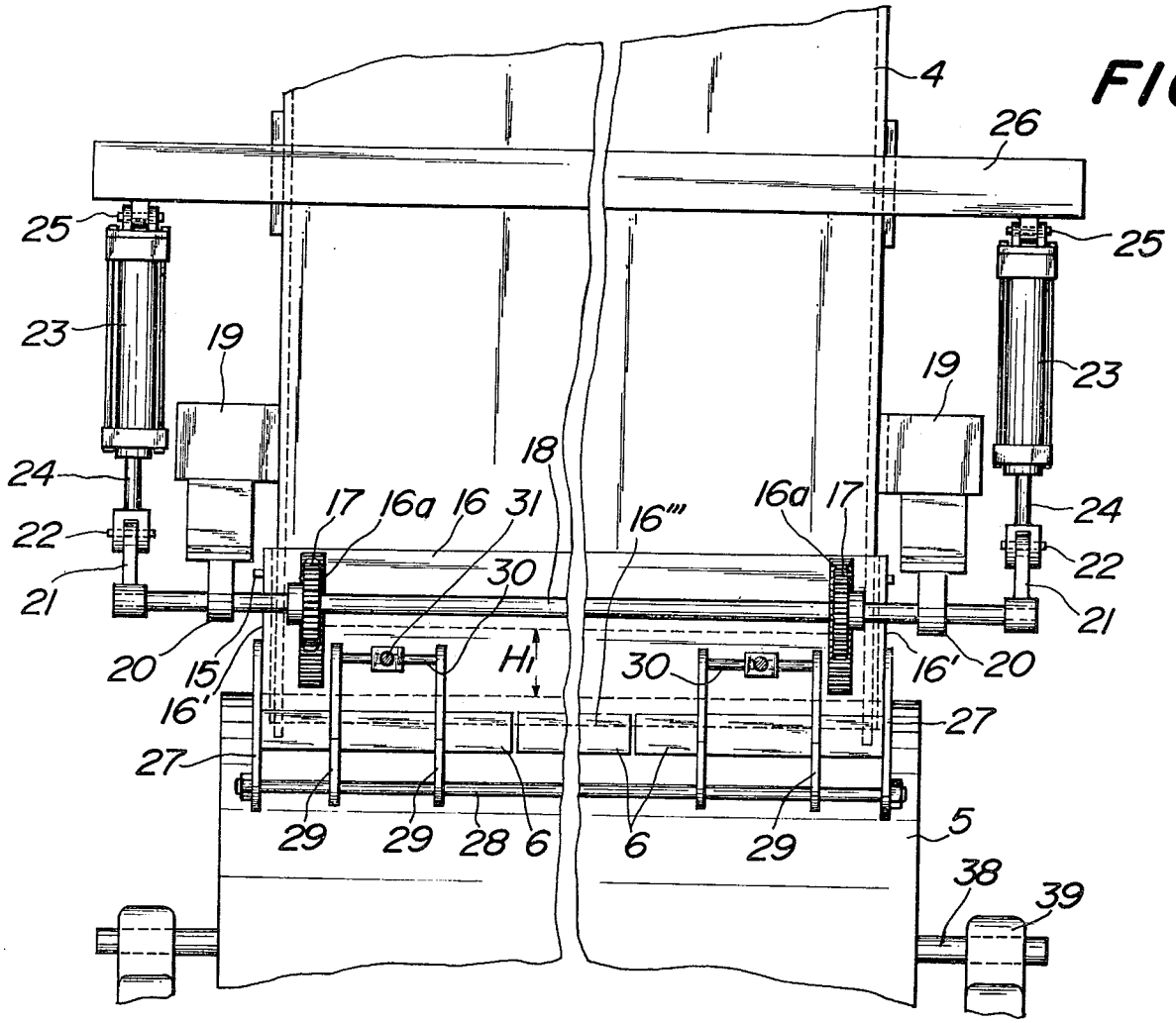
FIG. 5 is a front elevational view seen in a direction A—A of FIG. 3.

In FIGS. 3, 4 and 5 is shown means for operating the main and auxiliary gates. The means for operating the main gate 16 permits enlarging a normal opening height $H_2$ between the main gate 16 and the feeding drum 5 for the purpose of easily releasing a large lump of ore present in the surge hopper 4 out of the opening $H_1$, while the means for operating the auxiliary gates 6 serves to minutely adjust an opening height $H_3$ between each of the auxiliary gates 6 and the feeding drum 5.

The surge hopper 4 is provided at its rear side with a bracket 14 to each side of which are rotatably mounted through pins 15 the main gate 16. The main gate 16 is constructed by two side segments 16' closed at their front edges by a front arcuate plate 16'' and is adapted to open and close an opening $H_1$ of the hopper 4 by means of the lower edge 16''' of the front arcuate plate 16'' in response to the rotary movement of the main gate 16. The main gate 16 is provided at each side of its front arcuate plate 16'' with sector gears 16*a* adapted to be threadedly engaged with pinions 17.

The pinions 17 are keyed to a shaft 18 which is rotatably journalled in bearings 20 secured through brackets 19 to the surge hopper 4. The shaft 18 is provided at each end thereof with a curved lever 21 keyed thereto whose another end is connected through a pin 22 to a piston rod 24 of an air cylinder 23. The air cylinder 23 is suspended through a pin 25 from a supporting beam 26 secured to the surge hopper 4.

The main gate 16 is provided at its side plates 16′ with a pair of brackets 27 each projecting from one of the side plates 16′. The brackets 27, 27 are provided at their free ends with a shaft 28 secured thereto and extending in a direction perpendicular to the brackets 27, 27. Provision is made of a plurality of pairs of bell cranks 29 of which the number of one pair is made equal to the number of the auxiliary gates 6 and all of these bell cranks 29 are rotatably supported by the shaft 28.

Each auxiliary gate 6 is secured to the free ends of arms of one pair of the bell cranks 29, 29 whose another arms at their free ends are connected together by a shaft 30. The shaft 30 is connected through a rotatable joint bar 31 and universal joint 32 to a driving means 33.

Any oil pressure or air cylinder may be used as a driving source of the driving means 33. It is preferable to use as such driving source a reversible motor 34 as shown in FIG. 3. The motor 34 is connected through a reduction gear 35, ball thread shaft 36, and operating rod 37 to the universal joint 32. The ball thread shaft 36 is threadedly engaged with the operating rod 37 through a threaded bar 36*a* which is in mesh through balls with threads 37*a* of the operating rod 37.

Reference numeral 38 designates a shaft of the feeding drum 5, 39 its bearing and 40 a bed for supporting the driving means 33.

The operation of the above mentioned apparatus for adjusting the amount of raw mix to be sintered according to the invention is as follows.

If the air cylinder 23 is operated, it causes through the pinion 17 and sector gear 16*a* the main gate 16 to rotate from a position where the opening $H_1$ formed at the lower front side of the surge hopper 4 is substantially closed by the lower edge 16‴ of the arcuate front plate 16″ of the main gate 16 to a position where the opening $H_1$ is set to a normal opening height $H_2$ which is adjustable in dependence with the yield of the sinter, at which time the air cylinder 23 becomes inoperative.

If the motor 34 is energized by an electric signal supplied from a computer system C (FIG. 1) in response to the temperature distribution of the waste gas immediately after the waste gas passes through the bed A in a direction perpendicular thereto and has made contact with the thermometer 10 in the wind box 9′, the opening height $H_3$ between the auxiliary gate 6 and the feeding drum 5 can be minutely adjusted so as to evenly sinter the raw mix disposed on the pallet 2.

If a region in the transverse direction of the bed A is overheated, it is necessary to increase the opening height $H_3$ of the auxiliary gate 6 corresponding to the above mentioned region. In such case, the motor 34 belonging to the auxiliary gate 6 opposite to said region is energized to move the joint bar 31 to the right so as to rotate the bell cranks 29 about the shaft 28 in a clockwise direction and hence separate the lower edge of the auxiliary gate 6 from the feeding drum 5.

On the contrary, if a region in the transverse direction to the bed A becomes underheated, it is necessary to decrease the opening height $H_3$ of the auxiliary gate 6 corresponding to this region. In this case, the motor 34 belonging to the auxiliary gate 6 opposite to this region is energized to move the joint bar 31 to the left so as to rotate the bell cranks 29 about the shaft 28 in a counter-clockwise direction and hence the lower edge of the auxiliary gate 6 approaches to the feeding drum 5.

The reciprocal movements of the joint bar 31 in right and left directions are effected by means of threaded engagement between the threaded bar 36*a* of the ball thread shaft 36 and the tapped hole 37*a* of the operating rod 37. That is, if the reversible motor 34 is energized to rotate through the reduction gear 35 the ball thread shaft 36 in forward or opposite direction, the threaded bar 36*a* is rotated in the tapped hole 37*a* of the operating rod 37, and as a result, the operating rod 37 is moved in right or left direction in dependence with the direction of rotation of the threaded bar 36*a*.

The operating rod 37 is slidably engaged with a guide sleeve 38*b* projected from a casing 35*a* to permit a rectilinear slidable movement of the operating rod 37 in left and right directions.

The auxiliary gates 6 are arranged side by side in front of the lower edge 16‴ of the main gate 16 as shown in FIGS. 4 and 5. If the opening height $H_3$ of each auxiliary gate 6 is adjusted by means of the motor 34, it is possible to suitably adjust the amount of the raw mix to be sintered along the transverse direction of the pallet 2. Such adjustment of the distribution of the raw mix to be sintered along the transverse direction of the pallet 2 is quite essential for preventing the bed A from being unevenly sintered.

Large raw mix present in the surge hopper 4 may have a dimension which is not only larger than the adjustable opening height $H_3$ of the auxiliary gate 6 but also larger than the normal opening height $H_2$ of the main gate 16, and as a result, there is a risk of these openings being clogged with such larger raw mix. In such a case, the air cylinder 23 is operated to extend the piston rod 24 downwards so as to rotate the pinion 17 in a clockwise direction in FIG. 3 and hence rotate the main gate 16 about the pin 15 in a counter-clockwise direction. Such rotation of the main gate 16 causes the lower edge 16‴ thereof to separate from the feeding drum 5 and also through the link mechanism inclusive of the supporting arm 27, shaft 28, bell cranks 29, joint bar 31 and universal joint 32 all of the auxiliary gates 6 to separate from the feeding drum 5, thereby releasing and delivering the big lump of ore through the opening $H_1$ of the surge hopper 4 and openings $H_2$ and $H_3$ thus enlarged.

After the big lump of ore has been delivered through the opening $H_1$ of the surge hopper 4 and openings $H_2$ and $H_3$ the air cylinder 23 is operated to move the piston rod 24 in an opposite direction and hence restore the main gate 16 to its original position. Then, the above mentioned normal operation of feeding the mass of particle ore can be continued.

As explained hereinbefore, the invention not only permits the amount of raw mix to be accurately adjusted in response to the sintered state of the ore at the ore exit side, but also permits a big lump which may be present in the surge hopper 4 to be released in an easy manner. Thus, in accordance with the invention, the abnormal feeding operation which has been encountered with the presence of the big lump or ore for closing the openings $H_2$ and $H_3$ of the main and auxiliary gates 16, 6 can be restored to the normal feeding operating in a rapid and reliable manner.

It is preferable to provide five auxiliary gates 6 and arrange these five gates 6 side by side along the feeding drum 5 in its transverse direction in correspond with the five thermometers 10 arranged in the wind box 9'. If the change in the distribution of gas permeability through the bed A in its transverse direction at the ore inlet side of the machine causes the temperature distribution of the bed A at the sinter discharge side to change, the motors 34 belonging to respective gates 6 are driven such that the opening heights $H_3$ are adjusted so as to increase or decrease the amount of raw mix to be fed to the bed A in its transverse direction, whereby the change in the distribution of gas permeability can be corrected.

The cut-off plate 8 serves to apply pressure against the raw mix disposed on the pallet 2 so as to confine it into the bed A whose thickness in its transverse direction is substantially uniform. If any selected auxiliary gate 5 is operated to increase its opening height $H_3$, much amount of raw mix is delivered to that region of the bed A which is located in opposition to this auxiliary gate 6 and against this region of the bed A is applied a higher pressure by the cut-off plate 8 so as to increase the density of this region of the bed A. Conversely, if any selected auxiliary gate 6 is operated to decrease its opening height $H_3$, less amount of raw mix is delivered to that region of the bed A which is located in opposition to this auxiliary gate 6 and the density of this region of the bed A becomes decreased. Thus, the adjustment of the amount of raw mix to be fed to the bed A described ensures adjustment of the distribution of gas-permeability of the bed A in its transverse direction, thereby preventing the bed A from being unevenly sintered in the direction extending across the width of the bed.

As above described, to the computer system C shown in FIG. 1 is supplied electric signals representing the temperatures measured by the thermometers 10. The output from the computer system C which is an electric signal representing the change in the temperature of any selected region of the bed A in its transverse direction is supplied to the motor 34. The motor 34 is rotated in a direction such that the auxiliary gate 6 is operated to increase or decrease its opening height $H_3$, and as a result, the amount of raw mix to be fed to the bed A in its transverse direction is adjusted to make the gas-permeability distribution of the bed A in its transverse direction uniform, thereby preventing the bed A from being unevenly sintered in the direction extending across the width of the bed.

The mode of carrying out the invention will now be described with reference to a practical example.

EXAMPLE

Ores:

Average grain size—2.36 mm
Basicity—1.6
Coke Content—3.5%

Moving grate-type sintering machine:

Total length: 56 m
Width of pallet: 3.5 m
Number of wind boxes: 15

Length of the fifteenth wind box counted from the ore inlet side is 2 m and length of each of the first to fourteenth wind boxes is 4 m. In the present example, use was made of the above mentioned ore and sintering machine.

In accordance with the conventional method, use was made of the main gate only for the purpose of adjusting the amount of raw mix to be fed to the pallet and the strand speed was adjusted so as to avoid the deterioration of the sinter caused by the unevenness of sintering in the transverse direction of the bed.

In accordance with the invention, in the first place, the opening height $H_2$ was set by means of the main gate 16. Secondly, use was made of five equidistantly spaced apart thermometers 10 arranged in the fourteenth wind box 9' counted from the ore inlet side along its transverse direction. Third, the temperature distribution of the waste gas immediately after it has passed through the bed A was measured. Finally, the opening height $H_3$ was adjusted by means of the auxiliary gates 6 selected in dependence with the change of temperature of the waste gas immediately after it has passed through the bed A in a direction perpendicular to the bed, whereby unevenness of sintering effect subjected to the bed in its transverse direction was avoided.

The former conventional method was compared with the latter method according to the invention.

In the above two methods, the sintering operation was effected under such conditions that the opening height $H_2$ between the main gate 16 and the feeding drum 5 was set to 40 mm, that the moving speed of pallet 2 was 4 m/min, and that bed height A on the pallet 2 was 400 mm. In the conventional method, it was often obliged to decrease the strand speed slower than 4 m/min in order to avoid the degradation of the sinter on the pallet 2 in its transverse direction, and as a result, it was obliged to make the opening height $H_2$ narrow.

The sintering operation was effected for 5 hours in accordance with the conventional method, while it was effected from 5 to 8 hours in accordance with the method according to the invention. The temperatures of the waste gas immediately after it has passed through the bed A in a direction perpendicular to the bed were measured by the thermometers 10*a*, 10*b*, 10*c*, 10*d* and 10*e* shown in FIG. 2A, respectively. The results obtained are shown by curves 10*a*, 10*b*, 10*c*, 10*d* and 10*e* in FIG. 6. As seen from FIG. 6, the temperature distribution of the waste gas in the transverse direction of the bed A sintered in accordance with the conventional method for 5 hours is very irregular, but it becomes substantially uniform during the sintering method according to the invention for a period of 5 to 8 hours.

The results of the sintering operations effected by the method according to the invention and by the conventional method, are also shown in the following table.

Table

| | | Temperature of waste gas in the 14th wind box | | Bed height | Strand speed | Yield | Shatter index | Rate of producing ore to be fed back |
|---|---|---|---|---|---|---|---|---|
| | | $\bar{x}$ (°C) | R (°C) | (mm) | (m/min) | (t/hr.m²) | (%) | (%) |
| Method according to the invention | | 405 | 15 | 400 | 4.1 | 1.81 | 85.4 | 18.2 |
| Conventional method | 1 | 410 | 168 | 400 | 4.0 | 1.63 | 83.0 | 20.1 |
| | 2 | 430 | 82 | 400 | 3.4 | 1.52 | 85.2 | 18.8 |

Note: The data of the conventional method 1 are those when the bed was unevenly sintered, while the data of the conventional method 2 are those when the bed was evenly sintered by retarding the strand speed.

$\bar{x}$ is an average value of five temperatures of the waste gas measured at five different regions along the transverse direction of the 14th wind box, and R is a temperature difference between the temperatures of the waste gas measured at these five regions.

The average value $\bar{x}$ of five temperatures of the waste gas measured at five different regions extending across the 14th wind box 9', and the temperature difference R between the temperature of the waste gas measured at these five regions and the average value $\bar{x}$ can be determined as follows. The object of the invention is to minutely adjust the opening height $H_3$ between each of the auxiliary gates 6 and the feeding drum 5 such that the temperature of the waste gas passing through five points 10*a*–10*e* arranged side by side and extending across the width of the bed A in the wind box 9' located at the exit end of the sintering machine lies within an allowable temperature range compared with the average value $\bar{x}$ even though this temperature deviates from the average value $\bar{x}$ of five temperatures of the waste gas measured at five different regions 10*a*–10*e*.

For this purpose the temperature of the waste gas is measured at these five different regions by the five thermometers 10*a*–10*e* every one minute. The electric output produced from each of these thermometers 10*a*–10*e* is read out by the computer C. For purposes of illustration, let the read out value be Tn, *i* where *n* is a read out period. As a result, let Tn, *i* be the read out value at the present time, then the preceding read out value (at one minute prior to the present time) is represented by Tn-1, *i* where *i* is a position extending across the bed A. In the present illustration, *i*=1, 2, 3, 4 and 5. In order to obviate the influence of change of the instantaneous permeability upon the temperature of the waste gas, the temperature of the waste gas measured at each of five positions 10*a*–10*e* extending across the wind box 9' can be exponentially graduated as given by the following equations:

$$\hat{T}n, i = \alpha \cdot \hat{T}n-1, i + (1-\alpha) \cdot TN, i$$

$$= \alpha(\hat{T}n-1, i - Tn, i) + Tn, i$$

where $\alpha$ is the graduation constant which is $0 \leqq \alpha < 1$, $\hat{T}n, i$ is the temperature of the waste gas measured by the thermometer at the ith position and graduation by using the read out data at the present time, and $\hat{T}n-1, i$ is the temperature of the waste gas calculated by the similar equation at the preceding time (one minute before).

Then, use can be made of $\hat{T}n, i$ to obtain an arithmethical average value $\bar{T}n$ of the temperature of the waste gas extending across the bed A (or the wind box 9') by the following equation:

$$\bar{T}n = \frac{1}{5} \sum_{i=1}^{5} \hat{T}n, i.$$

The difference between the average temperature *T*n and *T*n, *i* *is given by:*

$$Dn, i = \hat{T}n, i - \hat{T}n.$$

These values $\bar{T}n$ (in the present specification $\bar{x}$) and *D*n, *i* (in the present specification R) are determined by the customary counting process effected in the computer C.

Then, $|Dn, i|$ can be compared with an allowable range (ID) of the deviation of the temperature of the waste gas at each point of five points 10*a*–10*e* extending across the bed A defined beforehand from its average value. If in the ith position the relation:

$$|Dn, i| \leqq |D|$$

is satisfied, the opening height $H_3$ between each of the auxiliary gates 6 and the feeding drum 5 is not adjusted. If in the ith position the relation is given by:

$$|Dn, i| > |D|,$$

the opening height $H_3$ is minutely adjusted. If, in a plurality of positions, the relation is given by:

$$|Dn, i| > D|,$$

the minute adjustment of the opening height $H_3$ is effected at the ith position only where the difference $|Dn, i| - |D|$ is maximum.

Furthermore, let the amount of change of the opening height $H_3$ at the ith position be *U*n, *i*, the *U*n, *i* is given by:

$$Un, i = K \cdot Dn, i,$$

where *K* is a constant which is predetermined by measuring the relation between the amount of change of the opening height $H_3$ and the amount of change of the waste gas corresponding thereto or K may be calculated for the actual time on line and adapted to be corrected.

About 10 minutes is required between changing the opening height $H_3$ to the detection of the corresponding temperature of the waste gas in the wind box 9', and as a result, once the opening height $H_3$ is changed, the next change of the opening height $H_3$ is effected after about 10 minutes. Let this about 10 minutes be $t$. That is, $t$ is a time during which the raw material delivered from the feeding drum 5 is moved by the pallet 2 to the position above the wind box 9'. This time $t$ can be set beforehand.

During the time from the minute adjustment of the opening height $H_3$ of the auxiliary gate 6 at the ith position where the difference $|Dn, i| - |D|$ is maximum is minutely adjusted to a time shorter than $t$ minutes, the minute adjustment of the opening height $H_3$ of the auxiliary gate 6 may be effected at the ith position where the difference $|Dn, i| - |D|$ is next to the maximum.

It should be noted that the five auxiliary gates 6 and the five thermometers 10*a*–10*e* in the wind boxes 9' shown in FIG. 1 are arranged as shown in FIG. 7.

The unevenness of the waste gas temperature distribution is determined by the computer C in customary manner. That is, the computer is capable of performing calculations such as given by:

$$Dn, i = \hat{T}n, i - \overline{T}n$$

where $$\overline{T}n = \frac{1}{5} \sum_{i=1}^{5} \hat{T}n, i.$$

The unevenness $Dn, i$ (in the present specification R) is the difference between the waste gas temperature measured by the ith thermometer $\hat{T}n, i$ and the average temperature $\overline{T}n$ (in the present specification $\overline{x}$ $$= \left( \frac{1}{5} \sum_{i=1}^{5} Tn, i \right).$$

The time interval for observing the temperature distribution of the waste gas is about 10 minutes. This time interval of about 10 minutes is required for the raw material delivered from the feeding drum 5 to the pallet 2 to move toward the wind box 9' and arrive thereat.

The temperature measured by the thermometers 10*a*–10*e* (of FIG. 2) is delivered therefrom as an electrical signal representing $Tn, i$ into the computer C where the unevenness $Dn, i$ (=$R$) is obtained by calculation and is delivered as an electrical signal to the reversible motor 34 to minutely adjust the opening height $H_3$ and hence increase or decrease the amount of raw material delivered to the feeding drum 5.

In case of carrying out the method according to the invention, the relation between the change in the waste gas temperature and the adjustment of the opening height $H_3$ of the auxiliary gate 6 is determined such that an increase of about 10 mm of the opening height $H_3$ of the auxiliary gate results in a temperature drop of about 100° C. Thus, the opening height $H_3$ of the auxiliary gate 6 is increased or decreased several millimeters in response to the unevenness of the temperature distribution of the waste gas. Then, the temperature distribution of the waste gas is observed every ten minutes or so after the result of the adjustment of the opening height $H_3$ of the auxiliary gate has appeared in the bed A as a new temperature distribution of the waste gas, and as a result, the sintering temperature distribution in the transverse direction of the bed is improved. The above mentioned interval of time of ten minutes or so corresponds to the period during which the raw mix adjusted in its amount arrives at the 14th wind box 9'. The standard temperature of the waste gas in the 14th wind box 9' is determined by the operational experience and is of the order, for example, of 400° to 430° C. If the temperature of the waste gas in the 14th wind box 9' is deviated from this standard temperature, such temperature must be restored to the standard temperature.

The description and example given above are intended to illustrate the best mode of performing the invention. It is apparent that many modifications thereof may occur to those skilled in the art, which will fall within the scope of the following claims.

It is hereby claimed:

1. An apparatus for preventing raw mix from being unevenly sintered in a moving grate type sintering machine comprising a surge hopper having an opening at its lower front side, a feeding drum arranged immediately below said surge hopper, a main gate rotatable with respect to said feeding drum so as to adjust the height of said opening, a plurality of auxiliary gates arranged side by side in front of said main gate and between said main gate and said feeding drum and independently rotatable with respect to said feeding drum so as to adjust the height of adjacent regions of said opening which extend across the width of said opening, a pallet for receiving the raw mix to be sintered and transporting the mix through the sintering machine, said pallet being mounted for movement in an endless manner, a sloping plate arranged below said feeding drum and adpated to absorb the dropping energy of the raw mix as it falls into said pallet, a cut-off plate arranged above said pallet and adpated to apply pressure to the raw mix disposed on said pallet so as to form a bed, an ignition furnace positioned after said cut-off plate and into which is blown a controlled amount of combustion gas and air for igniting and sintering said bed, a plurality of wind boxes arranged side by side beneath said pallet in the longitudinal direction of said pallet for removing waste gas, a plurality of temperature measuring means arranged side by side in one of said wind boxes located at the exit end of the sintering machine and adapted to measure the temperature of the waste gas immediately after it passes through said bed in a direction perpendicular to said bed, computer means for receiving at its input an electrical signal representing the temperature of said waste gas measured by said temperature measuring means and supplying from its output an electrical signal representing the change in the temperature of any selected region extending across the width of said bed, means for rotating said main gate, means for rotating said auxiliary gates independently of each other, and link means for operatively connecting said main and auxiliary gates to their respective rotating means, said means for rotating said auxiliary gates acting in response to the electrical output signal from said computer means to adjust the amount of raw mix fed to regions extending across the width of said bed corresponding to the regions at which the temperature of the waste gas was measured.

2. The apparatus claimed in claim 1 wherein said link means for operatively connecting said auxiliary gates to their respective rotating means comprises a pair of bell cranks rotatably supported by said main gate and having one arm secured to said auxiliary gate and another arm connected to said rotating means.

3. The apparatus claimed in claim 3 wherein said link means for operatively connecting said main gate to its rotating means comprises pinions rotatably supported by brackets secured to said surge hopper and threadedly engaged with sector gears formed integral with said main gate and connected through a curved lever to said rotating means.

4. The apparatus claimed in claim 3 wherein said temperature measuring means comprises a chromel-alumel thermocouple type thermometer comprising a thermocouple well filled with MgO powder in which is embedded a sheath thermocouple having a diameter of 1.6 mm.

* * * * *